US006421831B1

(12) United States Patent
Korff

(10) Patent No.: US 6,421,831 B1
(45) Date of Patent: Jul. 23, 2002

(54) ERGONOMIC GARMENTS

(75) Inventor: Rikke Korff, Brussels (BE)

(73) Assignee: Levi Strauss & Co., San Francisco, CA (US)

( * ) Notice: Subject to any disclaimer, the term of this patent is extended or adjusted under 35 U.S.C. 154(b) by 0 days.

(21) Appl. No.: 09/415,688

(22) Filed: Oct. 8, 1999

(30) Foreign Application Priority Data

Jun. 9, 1999 (GB) ..... 2084022
Jun. 9, 1999 (GB) ..... 2084024

(51) Int. Cl.[7] ..... A41B 1/00; A41D 1/06
(52) U.S. Cl. ..... 2/69; 2/115; 2/227
(58) Field of Search ..... 2/69, 79, 227, 2/228, 238, 400–408, 105, 106, 108, 113–115, 83, 93, 94, 95, 80, 85, DIG. 4

(56) References Cited

U.S. PATENT DOCUMENTS

| | | | | | |
|---|---|---|---|---|---|
| 139,121 | A | | 5/1873 | Davis | |
| 1,999,927 | A | | 4/1935 | Grumbaum | |
| 2,237,818 | A | | 4/1941 | Grunbaum | |
| 2,968,813 | A | | 1/1961 | Bacharach | |
| 3,323,140 | A | * | 6/1967 | Morris | 2/227 |
| 3,744,052 | A | * | 7/1973 | Rector | 2/2.15 |
| 3,959,826 | A | * | 6/1976 | Hakanson | 2/227 |
| 3,996,622 | A | * | 12/1976 | Cooke | 2/227 |
| 4,015,318 | A | | 4/1977 | Hakanson | |
| 4,488,317 | A | * | 12/1984 | Polsky | 2/227 |
| 4,625,336 | A | * | 12/1986 | Derderian | 2/79 |
| 4,785,480 | A | * | 11/1988 | Polsky | 2/227 |
| 4,989,272 | A | * | 2/1991 | Wagner | 2/227 |
| 5,768,135 | A | | 6/1998 | Park et al. | |

FOREIGN PATENT DOCUMENTS

| | | |
|---|---|---|
| DE | M8905554 | 11/1990 |

* cited by examiner

*Primary Examiner*—Gloria M. Hale
(74) *Attorney, Agent, or Firm*—Medlen & Carroll, LLP

(57) ABSTRACT

Ergonomic garments are disclosed which provide a more three-dimensional fit than conventional garments. These ergonomic garments are characterized by seams which curve towards a plane of movement of the limbs of the wearer. Trousers are provided with legs having an outseam that curves towards a front longitudinal axis and an inseam that curves towards a rear longitudinal axis, or vice versa. Garments, shirts and blouses are provided with sleeves having one or more longitudinal seams that curve towards a longitudinal axis along the front or rear of the sleeve, coinciding with the plane of motion of the arm. Such garments provide more freedom of movement than conventional garments with straight seams.

26 Claims, 6 Drawing Sheets

ERGONOMIC GARMENTS

FIELD OF THE INVENTION

This invention relates generally to wearing apparel and more particularly to clothing constructed to accomodate the curvature and movement of the human body.

BACKGROUND OF THE INVENTION

Conventional clothing is typically constructed from a plurality of fabric workpieces which are joined together by forming seams. For competitive purposes, it is desirable to construct garments in ways which minimize the cost of manufacturing. This almost always results in garment pieces which are sewn together using as many straight seams as possible, since straight seams are easily produced inexpensively by machines. Curved or complex seams or stitching, which typically requires manipulation by human sewing machine operators, are kept to a minimum to reduce labor costs required to produce a garment. Such conventional construction techniques produce substantially two-dimensional, flat looking clothing, which is easily folded to take up minimal space in a retail environment, again reducing the cost of stocking product.

However, the human body is a three-dimensional, curved structure formed substantially of generally cylindrical shapes. So, when a garment is worn which maximizes the number of straight seams, the fit is frequently less than optimum, and the fabric of the garment in the direction of limb movement often impedes free movement of the wearer. This is because seams are conventionally located at the side: along the outside or inside edge of the arms or or legs or along the sides of the body. The extra space or room and fabric "give" which is typically found at the seams is therefore wasted, since legs and arms do not bend significantly in a direction to the side, but rather move more frequently in a plane which extends through the longitudinal axes found at the front and rear of the arms, legs and body. As a result, conventional clothing often restricts free and easy movement of the body, particularly when such clothing is close-fitting.

In recent times, customers have responded to restrictive or tight fitting clothing by purchasing clothing which is too large or "baggy". While such clothing does not restrict movement as a result of being too tight, the excess cloth which is present results in extra weight carried on the body, and can interfere with the free movement of the body by bunching or rubbing when extreme movements are carried out.

Accordingly, the need exists for good fitting clothing which is manufactured specifically to fit the three dimensional, substantially cylindrical shape of the human body in order to provide room for substantially free and comfortable movement.

SUMMARY OF THE INVENTION

The present invention provides ergonomic garments constructed from a plurality of workpieces of predetermined dimensions sewn together to form seams, in which at least one seam is curved towards a wearer's plane of movement.

In one embodiment the ergonomic garment is trousers having two legs, each trouser leg having an inseam and an outseam, and wherein the inseam and outseam curve towards a plane of movement longitudinally bisecting a front longitudinal axis and a rear longitudinal axis of each trouser leg. In the preferred embodiment, the outseam curves towards the front longitudinal axis and the inseam curves towards the rear longitudinal axis.

In another embodiment, the ergonomic garment is a sleeved garment for covering the upper body of a user, each sleeve having at least one seam curving towards a plane of movement longitudinally bisecting a front longitudinal axis and rear longitudinal axis of said sleeve.

In yet another embodiment, the present invention provides a method for constructing ergonomic garments from a plurality of fabric workpieces, wherein the fabric workpieces are cut to a predetermined size and shape for forming seams between said workpieces which curve towards a plane of movement of one or more limbs of the wearer, and the fabric workpieces so cut are sewn together in a predetermined manner for constructing the garment.

Other features and advantages of the invention will become apparent from the following detailed description, taken in conjunction with the accompany drawings, which illustrate, by way of example, the principles of the invention.

DETAILED DESCRIPTION OF A PREFERRED EMBODIMENT(S)

The ergonomic garments of the present invention have a more three-dimensional shape to provide sufficient fabric in the proper location to allow substantially free and unimpeded movement by the wearer.

Figure 1:
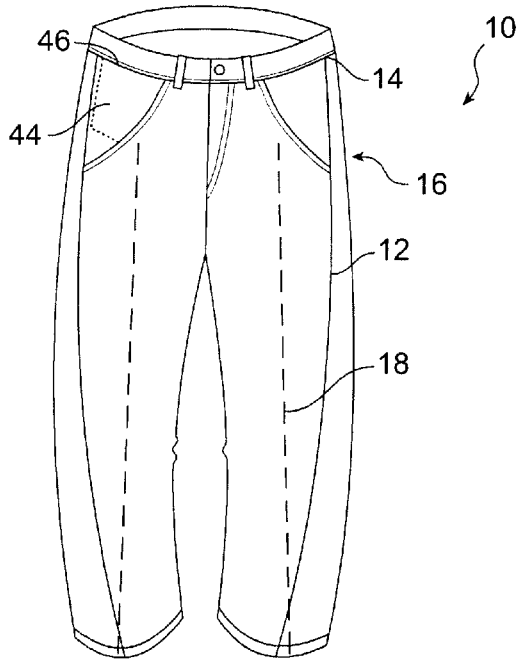
FIG. 1 is a perspective front view of a pair of trousers of the present invention.
Figure 2:
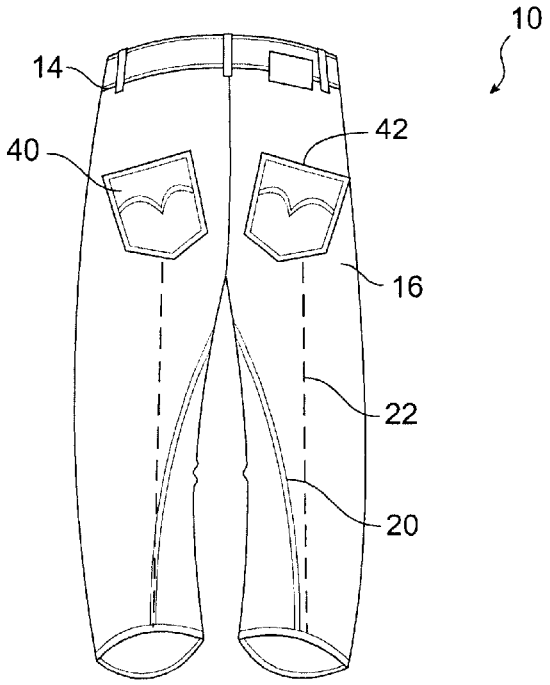
FIG. 2 is a perspective rear view of the trousers shown in FIG. 1.
Figure 3:
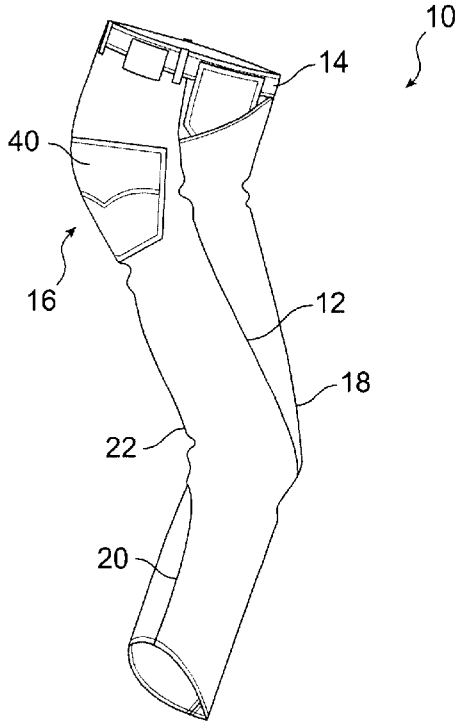
FIG. 3 is a perspective side view of a pair of trousers of the present invention.
Figure 10:
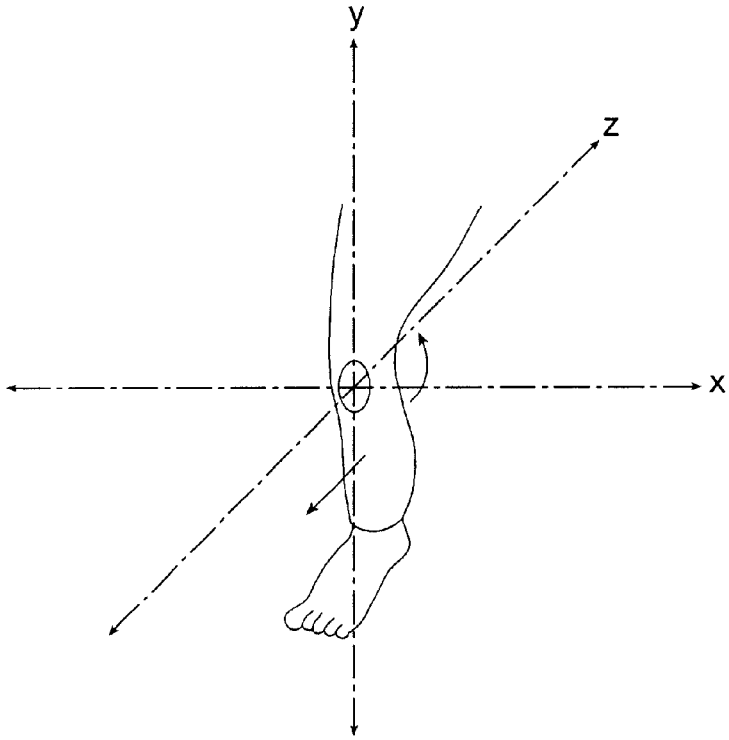
FIG. 10 is a diagram showing the plane of rotation of a limb.

FIGS. 1–3 illustrate one type of garment provided by the present invention—a pair of ergonomic trousers 10. To achieve the three-dimensional shape desirable to obtain a better fit to provide freedom of movement, it is necessary to place the seams in or near the "plane of movement" of the body part being clothed. The "plane of movement" is the plane in which a part of the body moves. For example, as shown in FIG. 10, the knee moves the lower leg in the plane YZ. The upper leg also moves substantially in the plane YZ. Therefore, it is highly preferred to move the seams of a pair of trousers from the inside and outside edges of the legs as close as possible to the front longitudinal axis 18 and rear longitudinal axis 22 of the legs so that they are near or in the plane of movement of the leg.

While it would be possible to completely redesign trousers to place the seams in front and back, rather than along the sides, this would require a radical redesign and would require very different, and likely costly construction techniques for forming the crotch and providing pockets. In addition, such a radical redesign might not be accepted by customers, even if the fit was substantially improved. Accordingly, as shown in FIGS. 1 and 3, we prefer to place the upper portion of outseam 12, from the waist 14 to about the seat 16, generally along the side of the body (or a little forward of the side of the body) where there is little movement to compensate for, and then to curve the outseam 12 towards the front longitudinal axis 18 of the leg. The inseam 20 is preferably curved from the crotch towards the back or rear longitudinal axis 22 of the leg, as shown in FIGS. 2 and 3. This curvature of the outseam 12 and inseam 20 is most easily obtained by reshaping the back panel and front leg panel fabric workpieces which are used in constructing the trousers. In some cases, it may also be desirable to combine the curved outseam and inseam with a crotch panel as is known in the art, for eliminating seams in the crotch region.

While it is most preferred, from a stylistic standpoint, to curve the outseam 12 towards the front longitudinal axis 18 of the leg and the inseam 20 towards the back longitudinal axis 22 of the leg, it would also be possible to reverse the direction, e.g., to move the outseam towards the back longitudinal axis 22 of the leg and the inseam 20 towards the front longitudinal axis 18 of the leg.

Figure 4:
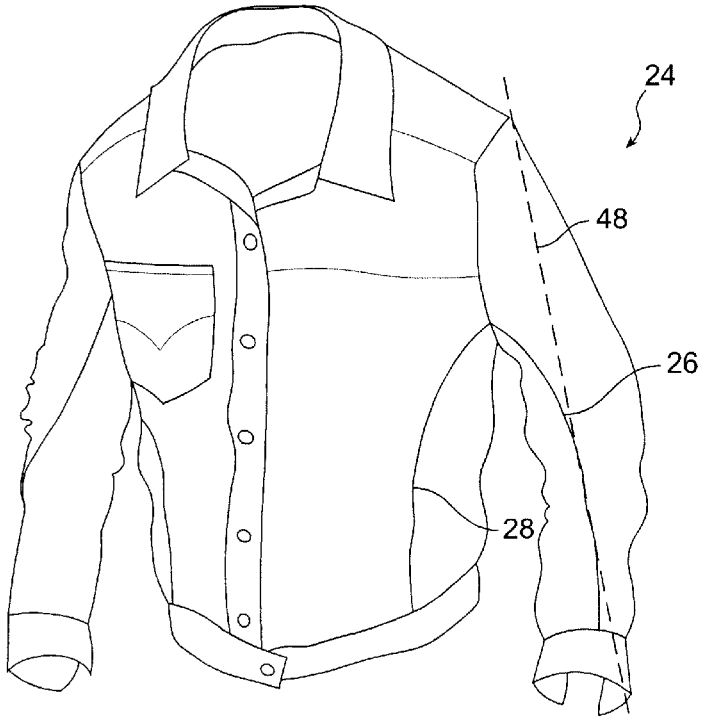
FIG. 4 is a front perspective view of a jacket of the present invention.
Figure 9:
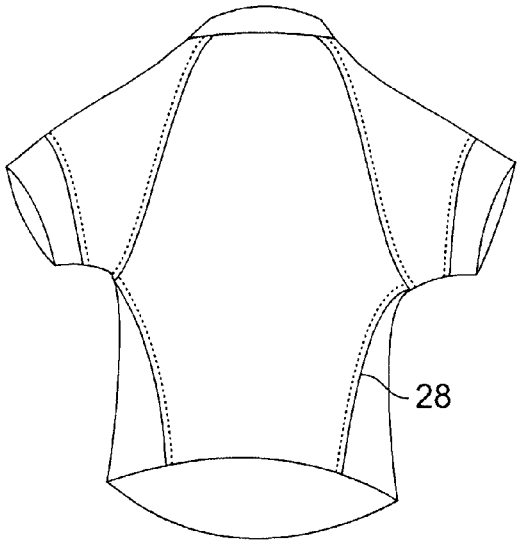
FIG. 9 is a back view of the shirt of FIG. 8.

The technique of moving the seams toward the plane of movement can also be applied to other garments as well, making them more three dimensional and better fitting. FIG. 4 shows a jacket 24 which includes a sleeve formed from a single fabric workpiece and a single sleeve inseam 26 which curves from its position near the armpit out towards the plane of movement at the front longitudinal axis 48 of the sleeve. This method of construction contrasts with the conventional method of placing the sleeve inseam along the inside of the arm where it is relatively concealed for substantially its entire length between the arm and the body. The method of this invention provides a sleeve which has a stylish look as well as a more three-dimensional fit. A better fit for the trunk of the wearer can also be provided by curving the side seams 28 towards the front of the wearer and the plane of movement which extends from the backbone through the breastbone and belly button. Similarly, the side seams 28 can be curved towards the rear of the wearer, as shown in FIG. 9.

Figure 5:
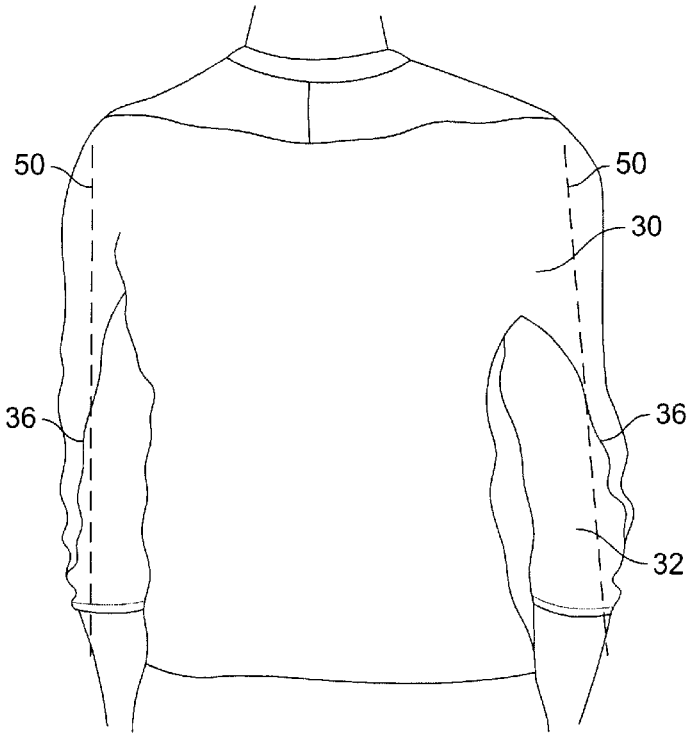
FIG. 5 is a back view of a shirt of the present invention.
Figure 6:
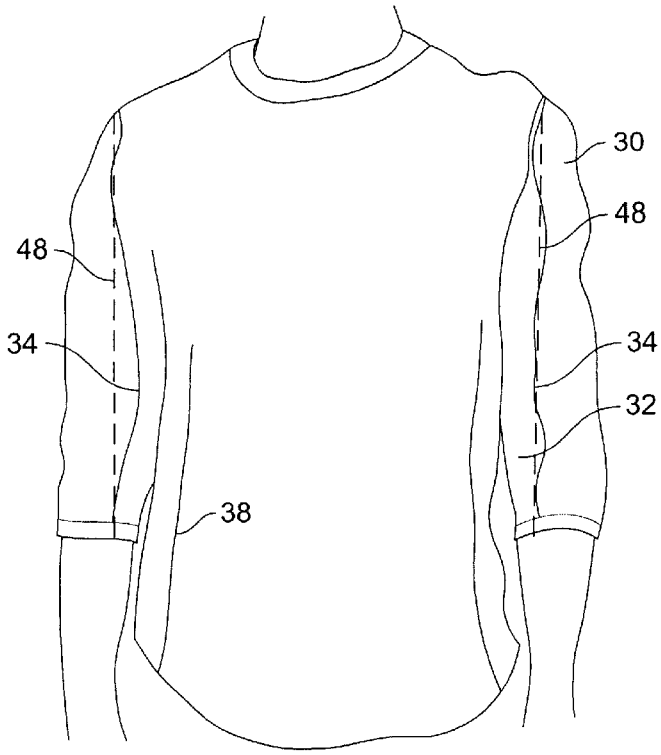
FIG. 6 is a front view of the shirt of FIG. 5.
Figure 7:
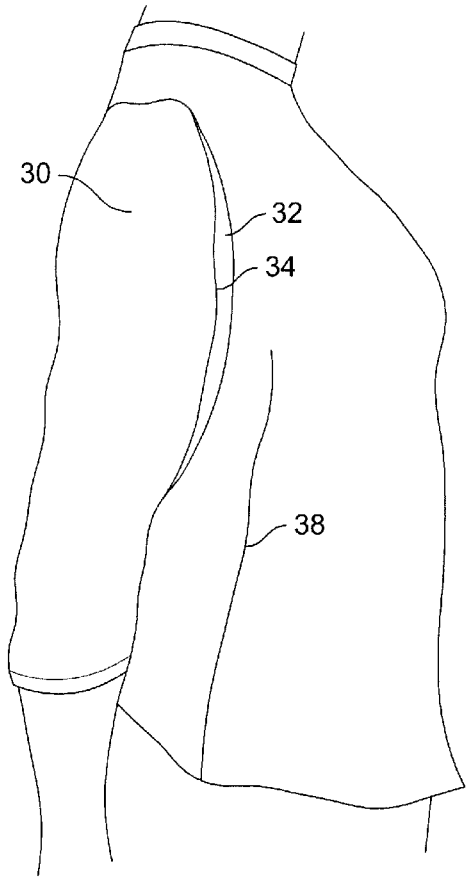
FIG. 7 is a side view of the shirt of FIG. 5.

A better fitting sleeved garment, shown in FIGS. 5–7, can be provided by constructing each sleeve from two fabric workpieces rather than one, and forming an inseam 36 and an outseam 34. A first fabric workpiece 30 forms the back of the garment and the outside portion of each sleeve. A second fabric workpiece 32 forms the inside portion of each sleeve. The outseam formed between workpieces 30, 32 extends from the shoulder down the front of the sleeve substantially along the plane of movement at the front longitudinal axis 48 of each sleeve. The inseam formed between workpieces 30, 32 extends from the armpit, curving towards the plane of movement that longitudinally bisects the elbow along the back longitudinal axis 50 of the sleeve. In addition, the trunk of the garment can be provided with a better more three-dimensional fit by providing side seams 38 that extend towards the plane of movement that extends from the backbone through the breastbone and belly button.

Figure 8:
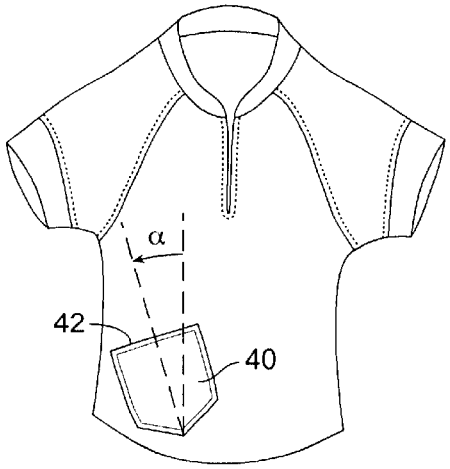
FIG. 8 is a front view of another shirt of the present invention.

Another feature which can modified on garments to make them more easily used by the wearer are the pockets. Conventional pockets are typically aligned vertically and horizontally, While aesthetically pleasing, this configuration often renders the pockets unusable. Accordingly, for the ergonomic garments of the present invention, we prefer dropping pockets further down on the garment and placing pockets at an angle a from the normal orientation, shown in FIG. 8, with the opening 42 of the pocket 40 facing the arm of the hand which will be using the pocket 40. This eases access to the pocket. As shown in FIG. 8, pockets 40 on shirts and/or jackets are preferably placed low on the front of the garment, with the opening of the pocket tilted or angled towards the arm of the hand which will access the pocket. As shown in FIGS. 2 and 3, when pockets 40 are placed on the back of a pair of trousers, they are dropped further down on the seat (rather than being located up closer to the waistband) and are tilted so that the opening 42 of each pocket 40 inclines toward the outseam of the trouser leg on which the pocket 40 is mounted, which also inclines the pocket opening towards the arm of the hand which is most likely to access that pocket. Small or vestigal pockets, such as watch pockets, are either eliminated entirely, or more preferably, are made larger and useful when used on ergonomic garments. As shown in FIG. 1, watch pocket 44 can be dramatically increased in size from its conventional size so that its width extends across substantially the entire width of the pocket opening, allowing the hand to be easily inserted through the watch pocket opening 46, which is located just beneath the waistband of trousers 10.

Figure 11:
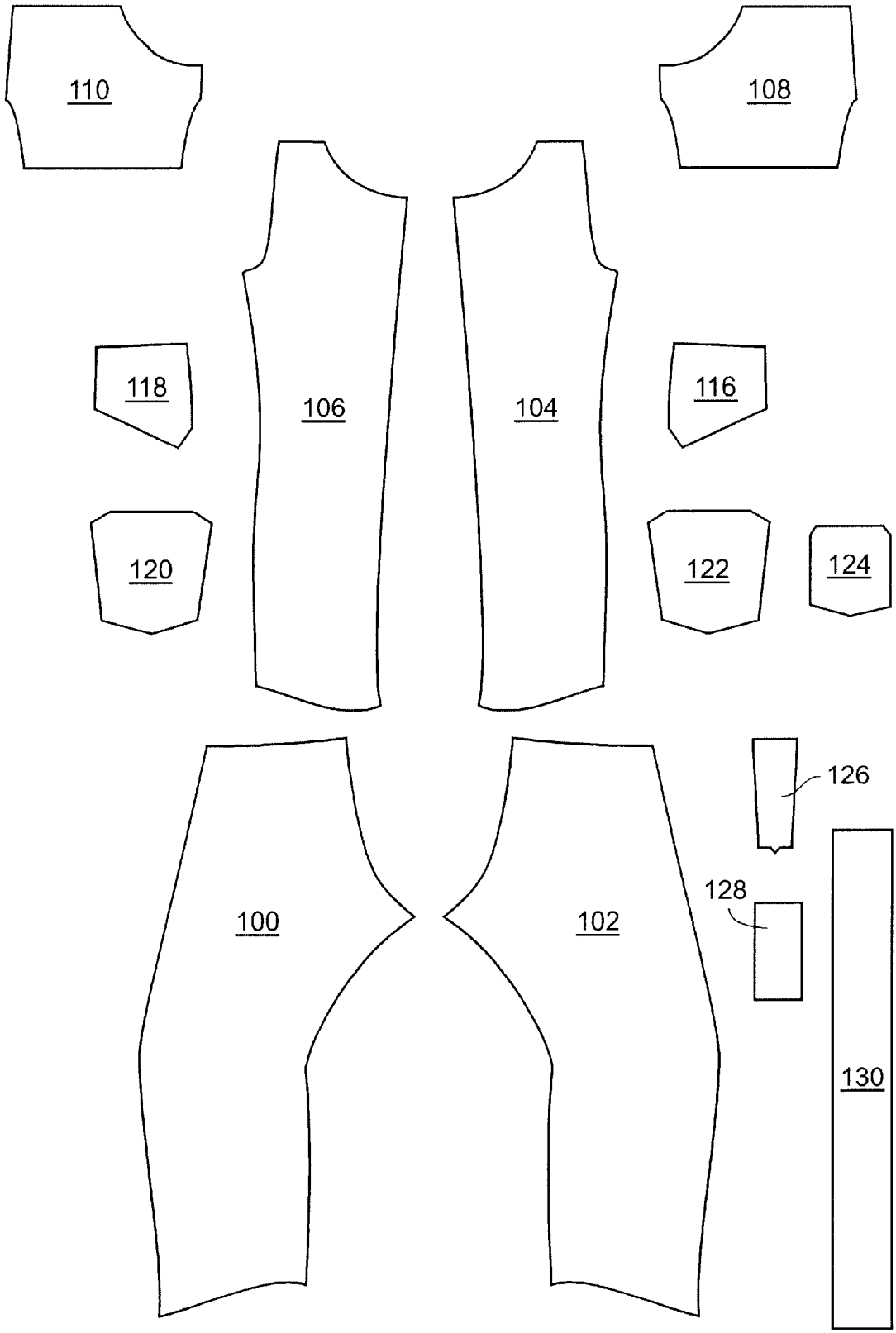
FIG. 11 illustrates fabric workpieces for constructing trousers of the present invention.

To construct ergonomic garments of the present invention, one must design garment workpieces having a predetermined size and shape which will provide the desired curvature to provide a good, three-dimensional fit. For example, as shown in FIG. 11, the workpieces needed to construct one style of trousers under the present invention include a right back panel 100, a left back panel 102, a right front panel 104, a left front panel 106, a waist band 120, a right and left front pocket 110, 108, a right and left front facing 118, 116, a right fly workpiece 126 and a left fly workpiece 128, right and left rear pockets 120, 122 and watch pocket 124. These pieces, and for this style most particularly the back panels, are shaped so that when they are sewn together as predetermined, an inseam will be formed that will curve towards the back longitudinal axis of each trouser leg and an outseam will be formed that will curve towards the front longitudinal axis of each trouser leg.

Those skilled in the art will appreciate that the embodiments described above are illustrative only, and that other systems in the spirit of the teachings herein fall within the scope of the invention.

What is claimed is:

1. An ergonomic garment constructed from a plurality of workpieces of predetermined dimensions joined together to form seams, in which at least one seam is formed during construction which curves towards a wearer's plane of movement, said garment comprising trousers having a right leg and a left leg, said right leg having a right outseam and said left leg having a left outseam, and wherein said right outseam curves towards a plane of movement longitudinally bisecting a front longitudinal axis and a rear longitudinal axis by curving towards one only of said front longitudinal axis and said rear longitudinal axis without crossing the other said longitudinal axis of said right trouser leg, and wherein said left outseam curves towards a plane of movement longitudinally bisecting a front longitudinal axis and a rear longitudinal axis by curving towards one only of said front longitudinal axis and said rear longitudinal axis without crossing the other said longitudinal axis of said left trouser leg, the right outseam forming a substantially symmetrical mirror image of said left outseam.

2. The ergonomic garment of claim 1 wherein said left outseam curves towards said front longitudinal axis of said left trouser leg without crossing said rear longitudinal axis of said left trouser leg, and wherein said right outseam curves towards said front longitudinal axis of said right trouser leg without crossing said rear longitudinal axis of said right trouser leg.

3. The ergonomic garment of claim 2, wherein said right trouser leg additionally comprises a right inseam and said left trouser leg comprises a left inseam.

4. The ergonomic garment of claim 1 additionally comprising a pocket mounted on at least one trouser leg, said pocket having a substantially straight opening angled towards said outseam.

5. An ergonomic garment constructed from a plurality of workpieces of predetermined dimensions joined together to form seams, in which at least one seam is formed during construction which curves towards a wearer's plane of movement without crossing both of a front longitudinal axis and a rear longitudinal axis bisected by said plane of movement, said ergonomic garment for covering the upper body of a wearer and having a left sleeve and a right sleeve, each sleeve having at least one seam, and wherein said seam of said right sleeve curves towards a plane of movement longitudinally bisecting a front longitudinal axis and a rear longitudinal axis of said right sleeve, and said seam of said left sleeve curves towards a plane of movement longitudinally bisecting a front longitudinal axis and a rear longitudinal axis of said left sleeve, said seam of said right sleeve forming a substantially symmetrical mirror image of said seam of said left sleeve.

6. The ergonomic garment of claim 5 wherein said seam of said right sleeve curves towards said front longitudinal axis of said right sleeve without crossing said rear longitudinal axis of said right sleeve, and wherein said seam of said left sleeve curves towards said front longitudinal axis of said left sleeve without crossing said rear longitudinal axis of said left sleeve.

7. The ergonomic garment of claim 5 wherein said seam of said left sleeve is an inseam which curves toward said rear longitudinal axis of said left sleeve without crossing said front longitudinal axis of said left sleeve, and wherein said seam of said right sleeve is an inseam which curves toward said rear longitudinal axis of said right sleeve without crossing said front longitudinal axis of said right sleeve, said inseam of said left sleeve forming a substantially symmetrical mirror image of said inseam of said right sleeve.

8. The ergonomic garment of claim 7 wherein said left sleeve additionally has an outseam, and wherein said outseam of said left sleeve curves toward said front longitudinal axis of said left sleeve without crossing said rear longitudinal axis of said left sleeve, and wherein said right sleeve additionally has an outseam, and wherein said outseam of said right sleeve curves toward said front longitudinal axis of said right sleeve without crossing said rear longitudinal axis of said right sleeve, said outseam of said left sleeve forming a substantially symmetrical mirror image of said outseam of said right sleeve.

9. The ergonomic garment of claim 5 including at least one pocket on a front portion of said garment, said pocket having an opening inclined to face the nearest sleeve.

10. The ergonomic garment of claim 5 selected from the group consisting of jackets, shirts, and blouses.

11. A method for constructing ergonomic garments from a plurality of fabric workpieces of predetermined size and shape for forming a garment of predetermined size, comprising:

cutting workpieces to a predetermined size and shape for forming a garment having at least one substantially mirror image pair of seams constructed to curve towards but not cross substantially more than one of a front longitudinal axis and a rear longitudinal axis both of which are bisected by a plane of movement of one or more limbs of a wearer;

joining said workpieces together in a predetermined manner to construct said garment.

12. The method of claim 11 wherein said workpieces are sewn together to form trousers.

13. The method of claim 12 wherein said seams include at least one seam forming a right trouser leg and at least one seam forming a left trouser leg, each said trouser leg having a front longitudinal axis and a rear longitudinal axis longitudinally bisecting a plane of movement of the wearer.

14. The method of claim 13 wherein said seam forming said right trouser leg is an outseam formed to curve towards said front longitudinal axis of said right trouser leg without crossing said rear longitudinal axis of said right trouser leg, and wherein said seam forming said left trouser leg is an outseam formed to curve towards said front longitudinal axis of said left trouser leg without crossing said rear longitudinal axis of said left trouser leg, whereby said outseam of said right trouser leg forms substantially a mirror image of said outseam of said left trouser leg.

15. The method of claim 13 wherein said seam forming said right trouser leg is an inseam formed to curve towards said rear longitudinal axis of said right trouser leg without crossing said front longitudinal axis of said right trouser leg and wherein said seam forming said left trouser leg is an inseam formed to curve towards said rear longitudinal axis of said left trouser leg without crossing said front longitudinal axis of said left trouser leg, whereby said inseam of said right trouser leg forms substantially a mirror image of said inseam of said left trouser leg.

16. The method of claim 11 wherein the workpieces are sewn together to form a sleeved garment for wear on an upper body portion of a wearer.

17. The method of claim 16 wherein said seams include at least a right arm inseam for forming a right arm sleeve having a front longitudinal axis and a rear longitudinal axis, said front longitudinal axis and said rear longitudinal axis of said right sleeve intersecting a plane of movement of said right arm, and a left arm inseam for forming a left arm sleeve having a front longitudinal axis and a rear longitudinal axis, said front longitudinal axis and said rear longitudinal axis of said left sleeve intersecting a plane of movement of said left arm, whereby said right arm inseam curves towards said front longitudinal axis of said right arm sleeve without crossing said rear longitudinal axis of said right arm sleeve and said left arm inseam curves towards said front longitudinal axis of said left arm sleeve without crossing said rear longitudinal axis of said left arm sleeve, said right arm inseam forming substantially a mirror image of said left arm inseam.

18. The method of claim 17 wherein said right arm sleeve additionally includes an outseam and wherein said left arm sleeve additionally includes an outseam, said outseam of said right arm sleeve forming substantially a mirror image of said outseam of said left arm sleeve.

19. The ergonomic garment of claim 3 wherein said right inseam curves towards said rear longitudinal axis of said right trouser leg without crossing said front longitudinal axis of said right trouser leg and said left inseam curves towards said rear longitudinal axis of said left trouser leg without crossing said front longitudinal axis of said left trouser leg.

20. The method of claim 14 wherein said right trouser leg and said left trouser leg each additionally include an inseam.

21. The method of claim 20 wherein said inseam of said right trouser leg curves towards said rear longitudinal axis of said right trouser leg without crossing said front longitudinal axis of said right trouser leg, and wherein said inseam of said left trouser leg curves towards said rear longitudinal axis of said left trouser leg without crossing said front longitudinal axis of said left trouser leg, whereby said inseam of said right trouser leg forms substantially a mirror image of said inseam of said left trouser leg, and said outseam of said right trouser leg forms substantially a mirror image of said outseam of said left trouser leg.

22. The method of claim 18 wherein said outseam of said right sleeve curves towards said rear longitudinal axis of said right sleeve without crossing said front longitudinal axis of said right sleeve, and wherein said outseam of said left sleeve curves towards said rear longitudinal axis of said left sleeve without crossing said front longitudinal axis of said left sleeve.

23. The garment of claim 4 wherein said pocket is mounted on a rear portion of said trouser leg.

24. The garment of claim 4 wherein said pocket is mounted on a front portion of said trouser leg.

25. An ergonomic garment constructed from a plurality of workpieces of predetermined dimensions sewn together to form seams, in which at least one seam is curved towards a wearer's plane of movement, said garment comprising trousers having two legs, each trouser leg having an inseam and an outseam, and wherein at least one of said inseam and said outseam curve towards a plane of movement longitudinally bisecting a front longitudinal axis and a rear longitudinal axis of said trouser leg, and additionally comprising a pocket mounted on a rear portion of at least one trouser leg, said pocket having an opening angled towards said outseam.

26. An ergonomic garment constructed from a plurality of workpieces of predetermined dimensions sewn together to form seams, in which at least one seam is curved towards a wearer's plane of movement, comprising a garment having two sleeves for covering the upper body of a wearer, each sleeve having at least one seam, and wherein said seam curves toward a plane of movement longitudinally bisecting a front longitudinal axis and a rear longitudinal axis of said sleeve and including at least one pocket on a front portion of said garment, said pocket having an opening inclined to face the nearest sleeve.

* * * * *